United States Patent [19]

Crane

[11] Patent Number: 4,761,205

[45] Date of Patent: Aug. 2, 1988

[54] SECURITY PAPER FOR CURRENCY AND BANKNOTES

[75] Inventor: Timothy T. Crane, Windsor, Mass.

[73] Assignee: Crane & Co., Dalton, Mass.

[21] Appl. No.: 942,805

[22] Filed: Dec. 17, 1986

Related U.S. Application Data

[62] Division of Ser. No. 804,825, Dec. 5, 1985, Pat. No. 4,652,015.

[51] Int. Cl.[4] ..... D21D 3/00; D21H 5/10

[52] U.S. Cl. ..... 162/103; 162/105; 162/134; 162/140

[58] Field of Search ..... 162/140, 103, 104, 105, 162/134, 108; 427/7; 428/916

[56] References Cited

U.S. PATENT DOCUMENTS

| | | | |
|---|---|---|---|
| 28,370 | 5/1860 | Howell | 162/140 |
| 3,880,706 | 4/1975 | Williams | 162/140 |
| 4,462,867 | 7/1984 | Fuller | 162/140 |
| 4,552,617 | 11/1985 | Crane | 162/140 |

*Primary Examiner*—Peter Chin

[57] ABSTRACT

Security devices in the form of metalized plastic films are incorporated within a security paper such as banknotes and other valuable documents during the papermaking process for viewing solely by means of transmitted light. The devices comprise printing of extreme fine line clarity and high opacity such that legibility is possible by means of transmitted light while remaining completely indiscernable under reflected light.

6 Claims, 3 Drawing Sheets

SECURITY PAPER FOR CURRENCY AND BANKNOTES

This is a divisional of application Ser. No. 804,825, filed Dec. 5, 1985 now U.S. Pat. No. 4,652,015.

BACKGROUND OF THE INVENTION

Methods are currently available for deploying a thin strip clear material such as polyester film within paper during the papermaking process. If the film is used as a security thread and is first microprinted prior to dispensation during the papermaking process the resulting paper then contains a legible code that is legible in transmitted light. With papers of the substance and thickness used for currency and banknotes, the code is also visible under transmitted light. The purpose of printed security threads is to deter a potential forger since the coded indicia on the thread is buried within the paper and can not be duplicated by surface printing techniques. The authenticity of such a document can be readily verified by comparing the appearance of the security thread under reflected light against its appearance in transmitted light. It is the reflected light appearance that is most relied upon by the public when handling currency and banknotes in general circulation. The reflected light appearance, however, does not directly reveal the presence of the printing that is completely legible in transmitted light. In fact, the nondistinct muted line of the security thread that is conspicuous at the surface of the currency and banknotes becomes the distinctive feature in the eyes of the general public.

The inclusion of the security device within the body of the security paper now requires sophisticated papermaking machinery which is not available to forgers. One method of incorporating the security device is described within U.S. Pat. No. 3,880,706 to Williams wherein the security device is sandwiched between two layers of formed paper midway during the papermaking process.

An opaque item embedded within security paper is also described as early as the issue dates of U.S. Pat. Nos. 210,089, 964,014 and 1,929,828. It is believed that the two ply insertion approach disclosed within these patents detered feasibility for use within currency paper since the two ply papers could conceivably be replicated by laminating thin sheets of counterfeit paper without requiring a sophisticated papermaking machine. The simplicity in the configuration and design of the proposed security items were such that a forger could replicate them without a great deal of skill or expense.

Another method of incorporating the security device within the security paper comprises pressing the device within the wet paper fibers while the fibers are unconsolidated and pliable as taught by U.S. Pat. No. 4,534,398 to Timothy Crane which patent is incorporated herein for purposes of reference. In this method the security device is visible from one surface of the security paper for visual verification.

U.S. Pat. No. 4,552,617 also in the name of Timothy Crane describes a method of incorporating a security device within security paper by dissolving the security device carrier substrate and allowing the security device to be visually accessed from one side of the security paper.

All the aforementioned methods for incorporating security devices within the security paper allow for visible access to the presence of the security device by means of the unaided eye. The Williams approach could lead an observer to believe that a blurred line on the surface of the security paper, for example, is a sufficient indication of authenticity without requiring that the paper be held up to transmitted light for actual verification. The earlier security device also caused the security paper to exhibit an increased thickness in the vicinity of the device compared to the thickness of the paper itself. This increased thickness or "bulge" line can be duplicated by a skilled forger to lead the observer to believe that a security device is actually present, without further examination.

When an unprinted metalized plastic thread such as describe within the aforementioned patent to Williams is used as a security thread, the optical and electrical properties of the thread can be used for automatic verification by determining optical variations across the paper as well as by standard electronic metal detection techniques. It has been determined, however, that the optical properties of such a metalized thread can be duplicated to some extent by means of a pale but opaque line printed on the surface of the paper in the vicinity of where the security thread would be located. A dull pencil line may also fool the unskilled observer as to the presence of a buried security thread.

For reliable verification, the currency or banknote must be held up to a light source to reveal the coded indicia on the security thread that make a security thread virtually impossible to forge. The nondistinctive line that is the visible surface manifestation of the embedded security thread under reflected light is easily simulated also by a variety of printing processes.

Earlier attempts at printing on plastic stripes and embedding the strips within the paper have not heretofore proved feasible since the ink used to form the printed information that was legible under transmitted light also allowed the information to become legible under reflected light. The public could then rely upon the presence of the printed matter solely under reflected light, which printing is easily replicated by counterfeit means.

One way to insure that the public does not come to rely on such an easily simulated security thread characteristic is to manufacture currency and banknote paper containing a security thread that is virtually invisible under reflected light with no manifestation on the surface of the currency or banknote that such a security thread is present. This two fold test of authenticification namely, legible under transmitted light and invisible under reflected light, has heretofore not been met by any of the earlier noted devices.

The purpose of this invention therefore, is to provide a method for incorporating a security thread bearing printed information within security paper that is easily readable in transmitted light but virtually undetectable when it is viewed under reflected light: A further purpose of this invention is to provide the printed information at a specific location within the security paper and to economically produce the paper at high speeds using modern manufacturing techniques.

SUMMARY OF THE INVENTION

The invention comprises the encoding of printed information onto a strip of clear plastic film which is later incorporated within the paper during the papermaking process. The printed information can be visually read or machine detected. The methods of detection include differences in transmission optical density, differences in capacitance, and variations in the electrical current within a tuned resonance circuit.

The encoded information is confined within a narrow band on the plastic film which can be accurately located within currency, banknote or security paper without interferring with the speed of modern paper manufacturing equipment. In one embodiment, the printed information is a legible phrase, the letters of which are comprised of vacuum metalized aluminum having a thickness of 300–400 angstroms.

DESCRIPTION OF THE PREFERRED EMBODIMENT

Figure 1:
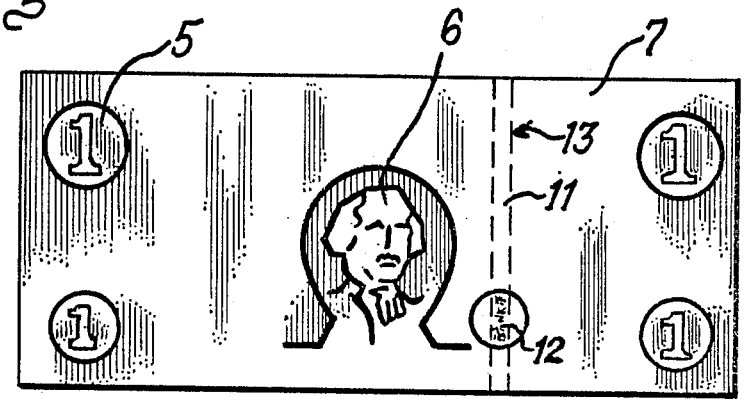
FIG. 1 is a plan view of a banknote incorporating a security device according to the invention.
Figure 1A:
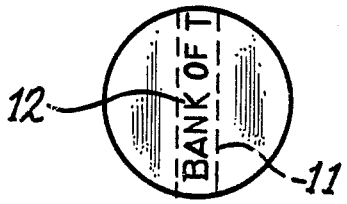
FIG. 1*a* is an enlarged plan view of the banknote of FIG. 1 depicting a legible phrase of the security device viewed in transmitted light.

The security paper of the invention finds application in the form of a banknote or currency such as the United States Federal reserve note 10 depicted in FIG. 1 as consisting of a rectangular sheet of paper 7 with a portrait 6 of a former United States President along with a numerical designation 5 of the value of the note. A plastic strip 11 is embedded within the paper in a manner to be described below in some detail. The strip extending in the direction defined by the parallel dotted lines is not readily visible on the surface of the paper under reflected illumination to the unaided eye. The strip itself has a planar configuration that is not discernable by touch, unlike the security threads used within some European currency that slightly distorts the surface of the paper and can actually be felt by gently rubbing the paper between one's fingers. Although the security threads are difficult to spot in new currency under reflected light, the presence of the earlier security thread becomes manifested by the blurred outlines of the thread apparently caused by repeated handling of the currency. A careless teller or cashier, for example, could be fooled by a carefully drawn soft pencil line in the same location one would expect to detect the security thread. The planar configuration of the plastic strip 11 insures that its presence remains undetected under reflected light even after long periods of continued use. When the bill is held up to a source of transmitted light or passed over a "light table" consisting of a transparent or transluscent surface over a strong source of light, the security indicia 12 shown in FIG. 1a becomes readily visible.

Figure 2:
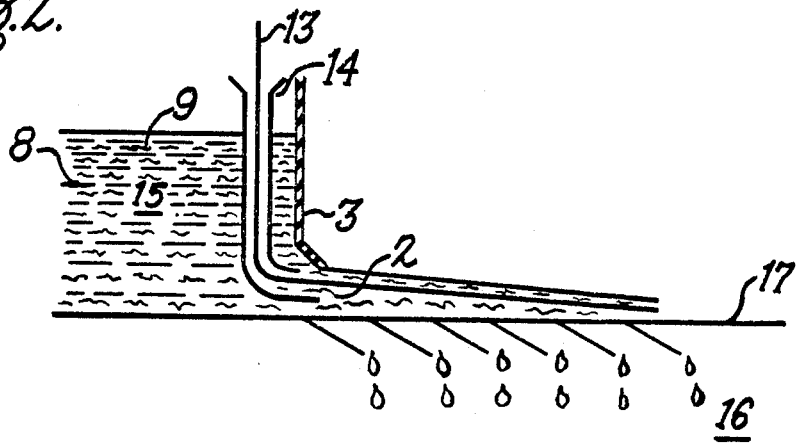
FIG. 2 is a side view in partial section of a fourdrenier papermaking machine with a funnel tube for introducing the security device from a continuous strip within the paper fibers.

The concept of embedding a security device within the paper fibers of a fourdrenier papermaking machine is described within the aforementioned U.S. Patent to Timothy Crane and one such fourdrenier machine is depicted at 16 in FIG. 2.

The headbox 3 contains a slurry 15 consisting of a mixture cellulosic fibers and fillers, all in a water vehicle illustrated by the dashed lines 8. The security strip 13 fed continuously from a reel (not shown) through a tube 14 into the slurry at the discharge outlet 2 of the headbox onto the fourdrenier wire 17. The fibers continuously surround the security strip as the slurry proceeds along the wire becoming dewatered and consolidated during the papermaking process. Once the paper has reached a final stage of dewatering, it is then passed through heated rollers for pressing and drying into a final paper product. The position of the tube 14 relative to the lateral extent of the wire 17 accurately determines the predetermined location of the security strip within the finished paper product.

Figure 3:
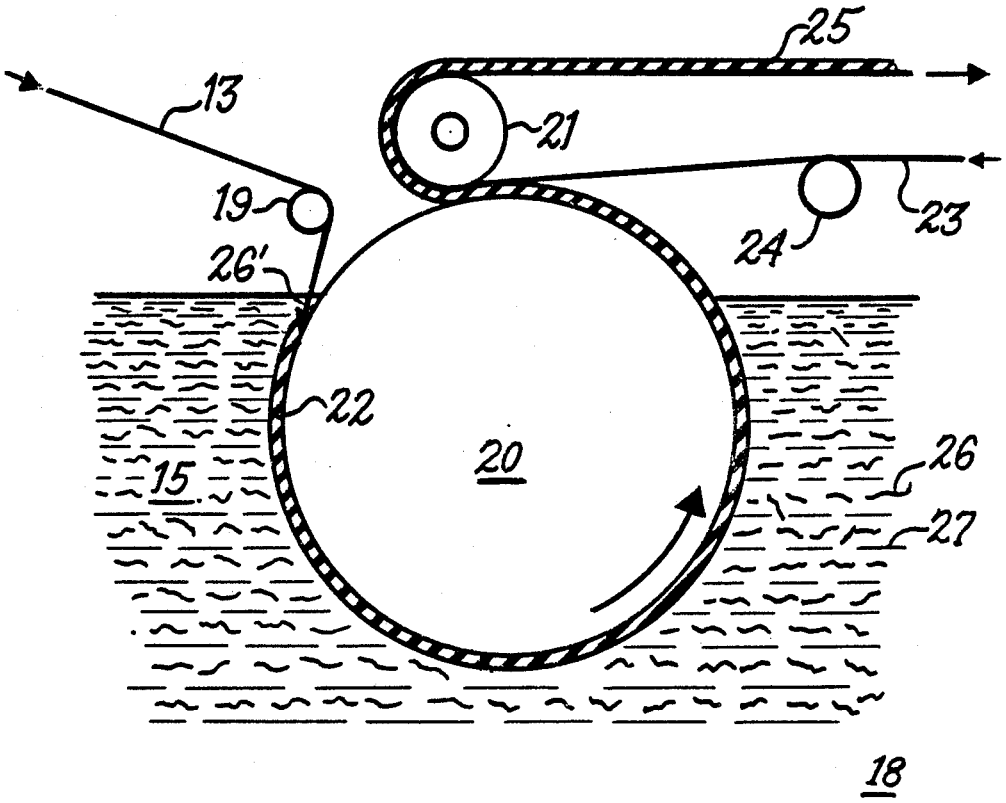
FIG. 3 is a side view in partial section of a cylinder type papermaking machine adopted for inserting the security device from a continuous strip within the paper fibers.

The concept of embedding a security device within the paper fibers of a cylinder mold papermaking machine is also described within the aforementioned patent to Timothy Crane and one such cylinder mold machine is shown at 18 in FIG. 3. The slurry 15 contains the same composition of paper fibers 26 is water 27 as that described earlier with reference to the slurry on FIG. 2. The security strip is fed from a reel (not shown) over a guide roll 19 onto the screen 22 of the cylinder 20 after some of the paper fibers have been gathered on the screen as indicated generally at 26'. The consolidated paper fibers containing the security strip is shown at 25 and is picked up from the cylinder by a felt 23 traveling in the indicated direction over a guide roll 24 onto a couch roll 21 and back in the opposite direction to the heating and pressing stages of the papermaking process to form the finished security paper.

Figure 4:
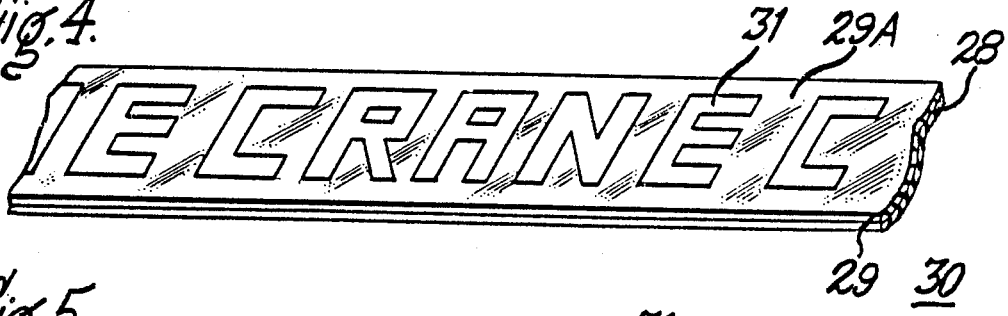
FIG. 4 is an enlarged top perspective view of a part of an aluminized polyester security device strip depicted in FIGS. 2 and 3 after a clear protective overcoat has been applied to the aluminized print.
Figure 5:
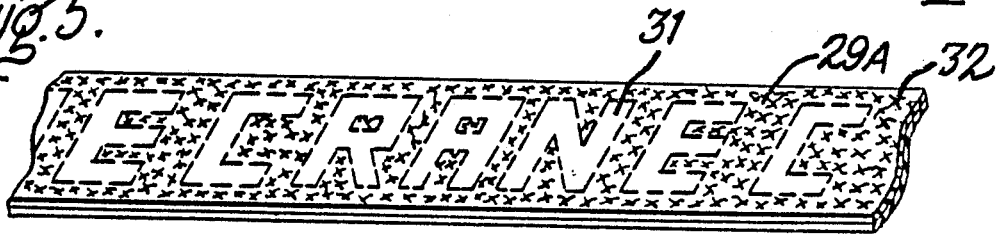
FIG. 5 is a top perspective view of an aluminized polyester security device film with a clear protective overcoat applied to the area where indicia is to be retained and after an etchant solution has been applied producing a soluble aluminum salt in the unprotected area.

A length 30 of the security strip 13 is shown in FIG. 4 to consist of a polyester film 28 overcoated with a vacuum deposited aluminum layer 29 which defines a planar aluminum coated surface 29A. The letters 31 spelling "CRANE", are printed onto the aluminum surface by means of a caustic resistant ink varnish. When an acid soluble metal such as tin is deposited on the polyester film, an acid resistive ink varnish is used to print the letters. The same length of security strip is shown at 30A in FIG. 5 with the unprotected area of the aluminum coated surface 29A covered with a plurality of crosses 32 to indicate the aluminum metal that must be removed by contact with a caustic solution of NaOH in water. The caustic resistant ink varnish protects the metal surface under the varnish from contact with the caustic. Although the varnish is effective in preventing the metal from becoming dissolved by the caustic NaOH solution it is noted that fine printing is best protected from becoming dissolved by the NaOH solution when the contact with the NaOH solution is as brief as possible. The sodium aluminate salt formed by reacting the unprotected aluminum with the NaOH solution is gently washed away from the surface by application of a clear water rinse.

Figure 6:
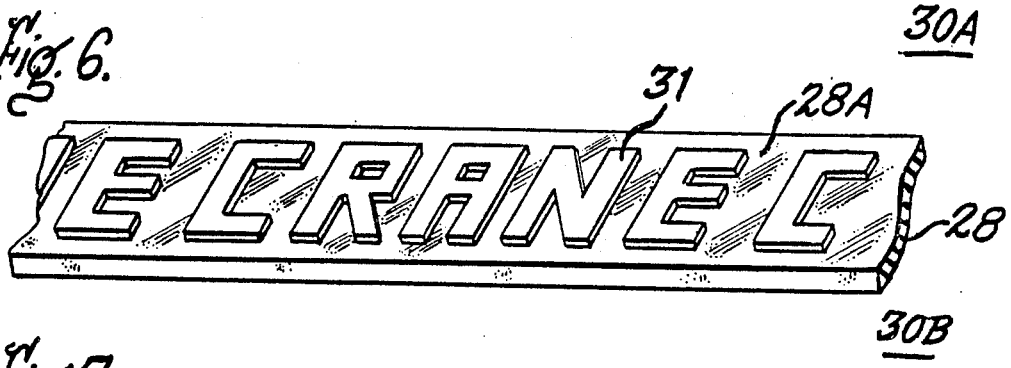
FIG. 6 is a top perspective of the security device film of FIG. 5 after the etchant solution has been applied; and the soluble aluminum salt has been removed.
Figure 7:
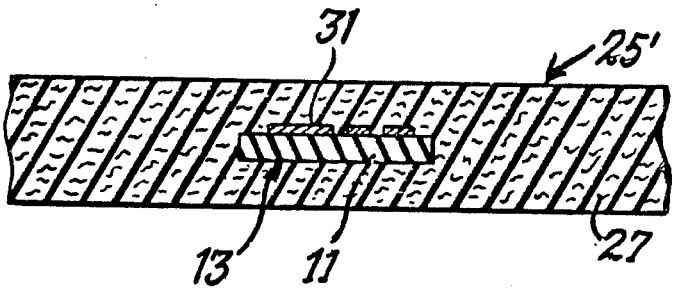
FIG. 7 is a side sectional view of the security device of FIG. 6 embedded within paper formed within the papermaking machines depicted in FIGS. 2 and 3 according to the invention.

The same length of security strip is shown at 30B in FIG. 6 with all the aluminum removed from the surface of the polyester film 28 and exhibiting a planar polyester surface 28A. The letters 31 remain intact on the surface after the dissolved metal is removed. Other methods of applying the letters to the surface can also be employed without departing from the scope of this invention. Legible printing or bar type optically readable codes can be directly hot stamped onto the polyester or applied via selective metalization using a mask or template in the vacuum metalizer. Various metal inks can be employed to directly print onto the polyester surface but only if the size of the print is sufficiently large that fine line clarity is not essential. The security paper 25 shown in FIG. 3 containing the security strip 13 embedded after heating and pressing is depicted at 25' in FIG. 7. The paper fibers 27 completely surround the security strip and prevent visual access to the security strip from either surface of the security paper. It is noted that the thickness of the paper is uniform and there is no bulge in the vicinity of the paper containing the security strip. This is an important feature of the invention for the reasons discussed earlier. Although the metal letters 31 on the plastic strip 11 are embedded within the paper fibers, these letters are readily visible when light is transmitted through the security paper from one surface and the security paper is viewed from the opposite surface when the thickness of the metal is between 300–400 angstroms and the thickness of the paper is from 4–6 thousandths of an inch.

It has thus been shown that a planar plastic film bearing either machine readable code or visually accessable letters can be embedded at a predetermined location within the currency and banknote paper for authentication in transmitted light. The code is invisible to the unaided eye under reflected light when viewed from either surface.

I claim:

1. A method of forming a security paper comprising the steps of:

depositing a metal layer on a continuous planar plastic film to form a metalized plastic film having reflective properties;

printing indicia on said metalized plastic film by means of an ink varnish which is resistant to a metal reactive solvent;

subjecting said printed plastic film to said metal reactive solvent to dissolve said metal layer except for said printed indicia to form a plastic film having metal indicia thereon;

inserting said plastic film and said metal indicia within a paper fiber slurry at a predetermined location in a papermaking machine during dewatering of said fiber slurry before said fiber is consolidated into a continuous paper web;

consolidating said paper fiber into a continuous paper web having said plastic film and said metal indicia contained within said paper web; and heating and pressing said paper web, said plastic film and said metal indicia to form a finished paper having a given length, said plastic film and said metal indicia being intermediate first and second opposing surfaces along said given length, said metal indicia being undetectable to the unaided eye under reflective illumination and becoming legible in transmitted illumination through both said surfaces at said predetermined location, said finished paper being essentially uniform along said given length.

2. The method of claim 1 wherein said plastic comprises polyester and said metal comprises aluminum.

3. The method of claim 2 including the step of forming said finished paper into a plurality of rectangular sheets having a pair of first opposing sides longer than a pair of second opposing sides to define a rectangle whereby said plastic film and said metal indicia extends along said rectangle parallel to said second opposing sides.

4. A method of forming a security paper comprising the steps of:

hot-stamping metal indicia onto a continuous planar plastic film;

inserting said plastic film and said metal indicia within a paper fiber slurry at a predetermined location in a papermaking machine during dewatering of said fiber slurry before said fiber is consolidated into a continuous paper web;

consolidating said paper fiber into a continuous paper web having said plastic film and said metal indicia contained within said paper web; and heating and pressing said paper web, said plastic film and said metal indicia to form a finished paper having a given length, said plastic film and said metal indicia intermediate first and second opposing surfaces along said given length, said metal indicia being undetectable to the unaided eye under reflective illumination and becoming legible in transmitted illumination through both said surfaces at said predetermined location, said finished paper being essentially uniform along said given length.

5. A method of forming a security paper comprising the steps of:

selectively metalizing metal indicia onto a continuous planar plastic film;

inserting said plastic film and said metal indicia within a paper fiber slurry at a predetermined location in a papermaking machine during dewatering of said fiber slurry before said fiber is consolidated into a continuous paper web;

consolidating said paper fiber into a continuous paper web having said plastic film and said metal indicia contained within said paper web; and heating and pressing said paper web, said plastic film and said metal indicia to form a finished paper having a given length, said plastic film and said metal indicia being intermediate first and second opposing surfaces along said given length, said metal indicia being undetectable to the unaided eye under reflective illumination and becoming legible in transmitted illumination through both said surfaces at said predetermined location, said finished paper being essentially uniform along said given length.

6. A method of forming a security paper comprising the steps of:

selectively transferring metal indicia from a substrate onto a continuous plastic film;

inserting said plastic film and said metal indicia within a paper fiber slurry at a predetermined location in a papermaking machine during dewatering of said fiber slurry before said fiber is consolidated into a continuous paper web;

consolidating said paper fiber into a continuous paper web having said plastic film and said metal indicia contained within said paper web; and heating and pressing said paper web, said plastic film and said metal indicia to form a finished paper having a given length, said plastic film and said metal indicia being intermediate first and second opposing surfaces along said given length, said metal indicia being undetectable to the unaided eye under reflective illumination and becoming legible in transmitted illumination through both said surfaces at said predetermined location, said finished paper being essentially uniform along said given length.

* * * * *